United States Patent [19]

Smith, IV

[11] Patent Number: 4,951,938

[45] Date of Patent: Aug. 28, 1990

[54] EXERCISE SHOE

[75] Inventor: Christopher J. B. Smith, IV, Oceanport, N.J.

[73] Assignee: Pro Stretch, Inc., Long Branch, N.J.

[21] Appl. No.: 323,763

[22] Filed: Mar. 15, 1989

[51] Int. Cl.[5] ..... A63B 23/04

[52] U.S. Cl. ..... 272/96; 128/25 B

[58] Field of Search ..... 272/96, 70, 70.1, 114, 272/146, 111, 97; 128/25 B, 80 R, 25 R, 80 D, 581; 36/110, 7.5

[56] References Cited

U.S. PATENT DOCUMENTS

| | | | |
|---|---|---|---|
| 2,390,416 | 12/1945 | Bettmann | 128/80 D |
| 3,472,508 | 10/1969 | Baker et al. | 272/96 |
| 4,206,558 | 6/1980 | Bivona | 272/70 X |
| 4,446,856 | 5/1984 | Jordon | 128/80 R |
| 4,821,432 | 4/1989 | Reiber | 36/110 |

*Primary Examiner*—Richard J. Apley
*Assistant Examiner*—H. N. Flaxman
*Attorney, Agent, or Firm*—R. Gale Rhodes, Jr.

[57] ABSTRACT

An exercise shoe including a semi-circular base providing a semi-circular sole plate on which the exercise shoe rocks. Attached to the base is a support which supports a heel support platform and a foot ball support platform. The semi-circular base and support have a generally diametrical axis and the heel support platform is inclined at an acute angle of 20°±5° with respect to the axis and the foot ball support platform is inclined at an acute angle of 30°±5° with respect to the axis. The user may employ two of such exercise shoes, one for each foot, then rocks back and forth on the shoes. The effect is to exercise, develop and toe the heel and toe flexors in the foot and calf muscles and the leg. Blood circulation to the lower leg is also stimulated.

2 Claims, 1 Drawing Sheet

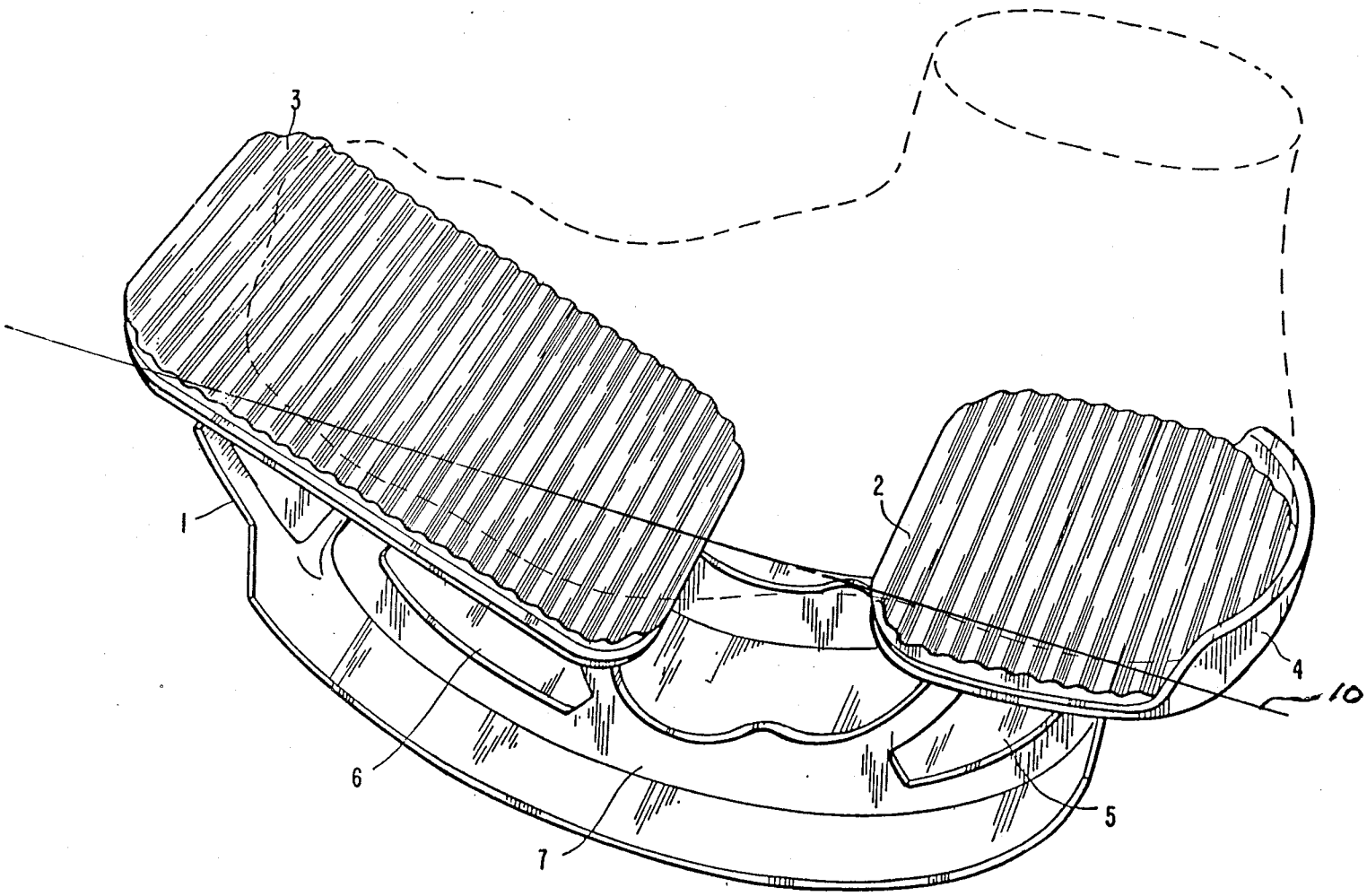
10
4
5
2
7
6
3
1

EXERCISE SHOE

FIELD OF THE INVENTION

This invention relates to an exercise shoe for the heel and toe flexors in the foot and the calf muscles in the leg. The shoe is of a type having a semi-circular base portion or sole plate and an inclined platform or foot portion formed within a first range of angles for the heel of the foot and a second range of angles for the ball of the foot so that the foot is caused to be located in a position such that the heel and toe flexor foot muscles are stretched. This, in turn, develops and exercises these foot as well as the calf muscles in the leg when the device is used in a rocking motion. Blood circulation to the lower leg is also stimulated.

DESCRIPTION OF THE PRIOR ART

U.S. Pat. No. 493,663 to Steuart discloses a shoe stilt employing a circular portion and a flat heel portion. This invention is a stilt arrangement without capability to rock because of the flat heel portion. Glowa U.S. Pat. No. 1,561,516 shows a shoe for assisting a walking motion. The shoe has a spring loaded plunger at the heel of dual full arcuate shaped runners. Bannister U.S. Pat. No. 2,283,595 relates to a stilt with a partial arcuate bottom portion and a flattened portion for affixing the shoe to the stilt. Jonas U.S. Pat. No. 2,810,213 shows an amusement device with a flat platform and a semicircular sole plate. Bivona U.S. Pat. No. 4,206,558 relates to an exercise shoe to simulate a jogging motion. The shoe has a hyperbolic sole plate or bottom surface and a planar foot support surface.

Grapin, et al. U.S. Pat. No. 4,247,996 relative to a shoe which is designed to extend the length of the wearer's stride which employs a semi-circular base or sole plate and a flat platform.

The prior art patents do not provide a device with an angled platform so that the heel and toe flexor foot muscles are stretched by the formation of the platform.

SUMMARY OF THE INVENTION

The present invention consists of a semi-circular base or sole plate with a flat bottom. Affixed to the sole plate is a platform or foot support surface which has two separate angled portions. A first heel support portion is inclined at an acute angle of 20°±5° with respect to the horizontal or axis 10 of the invention. A second support portion for the ball of the foot is provided which is inclined at an acute angle of 30°±5° with respect to the horizontal or axis 10 of the invention. The heel support and the ball support may be connected to each other to form a continuous surface or they may be separated from each other by a space.

A strap may be provided to hold the foot on the device. A toe guard may also be provided to house, protect and support the toes of the foot in the invention.

In any case, my invention is employed as an exercise device. The user steps onto a pair of devices (one for each foot) formed in accordance with my invention and utilizes the hands to support and steady the user. The user then rocks back and forth. The effect is to exercise, develop and tone the following muscle groups in the foot and leg; heel and toe flexors in the foot and calf muscles in the leg. Blood circulation to the lower leg is also stimulated.

A principal object of my invention is to provide an exercise device which can improve and tone the leg muscles. Another object of this invention is to provide an exercise device which can tone the following muscle groups: heel and toe flexors in the foot and calf muscles in the leg. A still further object of the invention is the provision of an exercise device for the foot and leg which has no moving parts. Another object of the invention is to provide an exercise device which has an angled heel platform support. An important object of the invention is the provision of an exercise device which has an angled support platform for the ball of the foot. Another object of my invention is an exercise show which results in blood circulation to the lower leg being stimulated.

BRIEF DESCRIPTION OF THE DRAWINGS

These as well as further objects and advantages of the invention will become apparent to those skilled in the art from a review of the following detailed specification of my invention, reference being made to the accompanying drawings in which:

The FIGURE is a perspective view of the apparatus of my invention.

DETAILED DESCRIPTION OF THE INVENTION

As shown in the FIGURE, the main part of the apparatus includes a semi-circular base 1 formed of a strong material such as metal, wood or plastic. The semi-circular base forms a uniform semi-circular sole plate surface on which the remainder of the device can "rock". The sole plate 1 and a support 7 attached thereto. To lighten the weight of the device and increase strength in the support 7, apertures 5 and 6 may be formed in the support 7.

Affixed to the support 7 is a heel support platform 2 and foot ball support platform 3. Each of these support platforms are inclined with respect to the horizontal. Heel support platform 2 is inclined at an acute angle of 20°±5° with respect to the axis 10. The support platform 3 for the ball of the foot is inclined at an angle of 30°±5° with respect to the axis 10. The purpose of these angled support portions is to enable the following muscle groups to be exercised and toned: heel and toe flexors in the foot and calf muscles in the leg. Blood circulation to the lower leg is also stimulated.

A raised shield 4 is provided around the rear of the heel support platform 2 to provide lateral support for the heel and assure safe use of the invention.

In use, a pair of the devices shown in the FIGURE are used, one for each foot. The person may utilize the hands to support and steady himself or herself during use of the device. The user then rocks back and forth.

As modifications to the foregoing may be made without departing from the spirit and scope of my invention, what is sought to be protected is set forth in the appended claims.

I claim:

1. An exercise shoe, comprising:

a semi-circular base portion having a generally diametrical axis extending therethrough and including a semi-circular sole plate on which the exercise shoe rocks on a support surface and a support extending generally upwardly from said sole plate and lying in a generally vertical plane;

a heel support platform affixed to said support and a foot ball support platform affixed to said support, said platforms disposed in a generally V-shaped disposition with respect to each other on said support with said heel support platform lying in a first inclined plane intersecting said generally vertical plane at right angles and with said foot ball support platform lying in a second inclined plane intersecting said generally vertical plane at right angles, said heel support platform and said first inclined plane inclined at an angle of 20°±5° with respect to said axis and said foot ball support platform and said second inclined plane inclined at an angle of 30°±5° with respect to said axis; and upon said exercise shoe rocking on said support surface said first and second inclined planes at all times intersecting said generally vertical plane at right angles.

2. The exercise shoe according to claim 1 wherein said heel support platform includes a rearward portion and wherein said rearward portion extends outwardly beyond said support and wherein a raised shield is provided around the rear of said heel support platform to provide lateral support for said heel of said person and assure safe use of the exercise shoe.

* * * * *